US007787799B2

(12) United States Patent
Ando et al.

(10) Patent No.: US 7,787,799 B2
(45) Date of Patent: Aug. 31, 2010

(54) CLEANING DEVICE AND IMAGE FORMING DEVICE

(75) Inventors: Hiroki Ando, Kanagawa (JP); Masayuki Kono, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 901 days.

(21) Appl. No.: 11/499,683

(22) Filed: Aug. 7, 2006

(65) Prior Publication Data

US 2007/0134019 A1 Jun. 14, 2007

(30) Foreign Application Priority Data

Dec. 8, 2005 (JP) ..... 2005-354859

(51) Int. Cl.
*G03G 15/02* (2006.01)

(52) U.S. Cl. ..... 399/100; 399/174; 399/176

(58) Field of Classification Search ..... 399/100, 399/174, 176
See application file for complete search history.

(56) References Cited

FOREIGN PATENT DOCUMENTS

| | | |
|---|---|---|
| JP | A-05-341624 | 12/1993 |
| JP | 10-63069 | 3/1998 |
| JP | 10-73983 | 3/1998 |
| JP | 2005-043715 | 2/2005 |

OTHER PUBLICATIONS

JP 2005043715 English Translation.*
Electronic Translation, JP 5341624 to Nakahara.*

* cited by examiner

*Primary Examiner*—David M Gray
*Assistant Examiner*—Ryan D Walsh
(74) *Attorney, Agent, or Firm*—Morgan, Lewis & Bockius LLP

(57) ABSTRACT

The present invention provides an image forming device. The image forming device includes a photosensitive body, a charging roller, a cleaning member, and a controller. The charging roller, while rotating in a first direction, charges the photosensitive body for image formation. The cleaning member, formed by an elastic body, contacts the charging roller and cleans the charging roller. The controller, when the charging roller is not carrying out charging of the photosensitive body for image formation, rotates the charging roller in a direction opposite to the first direction.

10 Claims, 10 Drawing Sheets

CLEANING DEVICE AND IMAGE FORMING DEVICE

BACKGROUND

1. Technical Field

The present invention relates to a cleaning device, particularly used to clean a rotatable body, and an image forming device having a photosensitive body, a charging roller which charges the photosensitive body, and a cleaning member which cleans the charging roller.

2. Related Art

In an image forming device using an electrophotographic method, charging of a photosensitive body is carried out by a charging roller or a corotron or the like. Exposure by an exposure device is carried out on the charged surface of the photosensitive body, such that an electrostatic latent image is formed. The electrostatic latent image on the photosensitive body is developed by a developing device. Then, transfer from the photosensitive body onto an intermediate transfer body or a recording medium or the like is carried out. The toner, which remains on the photosensitive body without being transferred, is cleaned by a cleaning member such as a blade or a roller or the like.

Here, in a case in which a charging roller is used, the toner, external additives of the toner, and the like which have passed through without being cleaned by the cleaning member, adhere to the charging roller. Because the charging performance deteriorates when such substances adhere to the charging roller, the charging roller is cleaned by a cleaning member such as a blade or the like.

SUMMARY

According to an aspect of the present invention, there is provided an image forming device. The image forming device includes: a photosensitive body; a charging roller that, while rotating in a first direction, charges the photosensitive body for image formation; a cleaning member, formed by an elastic body, that contacts the charging roller and cleans the charging roller; and a controller that, when the charging roller is not carrying out charging of the photosensitive body for image formation, rotates the charging roller in a direction opposite to the first direction.

BRIEF DESCRIPTION OF THE DRAWINGS

Exemplary embodiments of the present invention will be described in detail based on the following figures, wherein.

DETAILED DESCRIPTION

A first exemplary embodiment of the present invention will be described next on the basis of the drawings.

Figure 1:
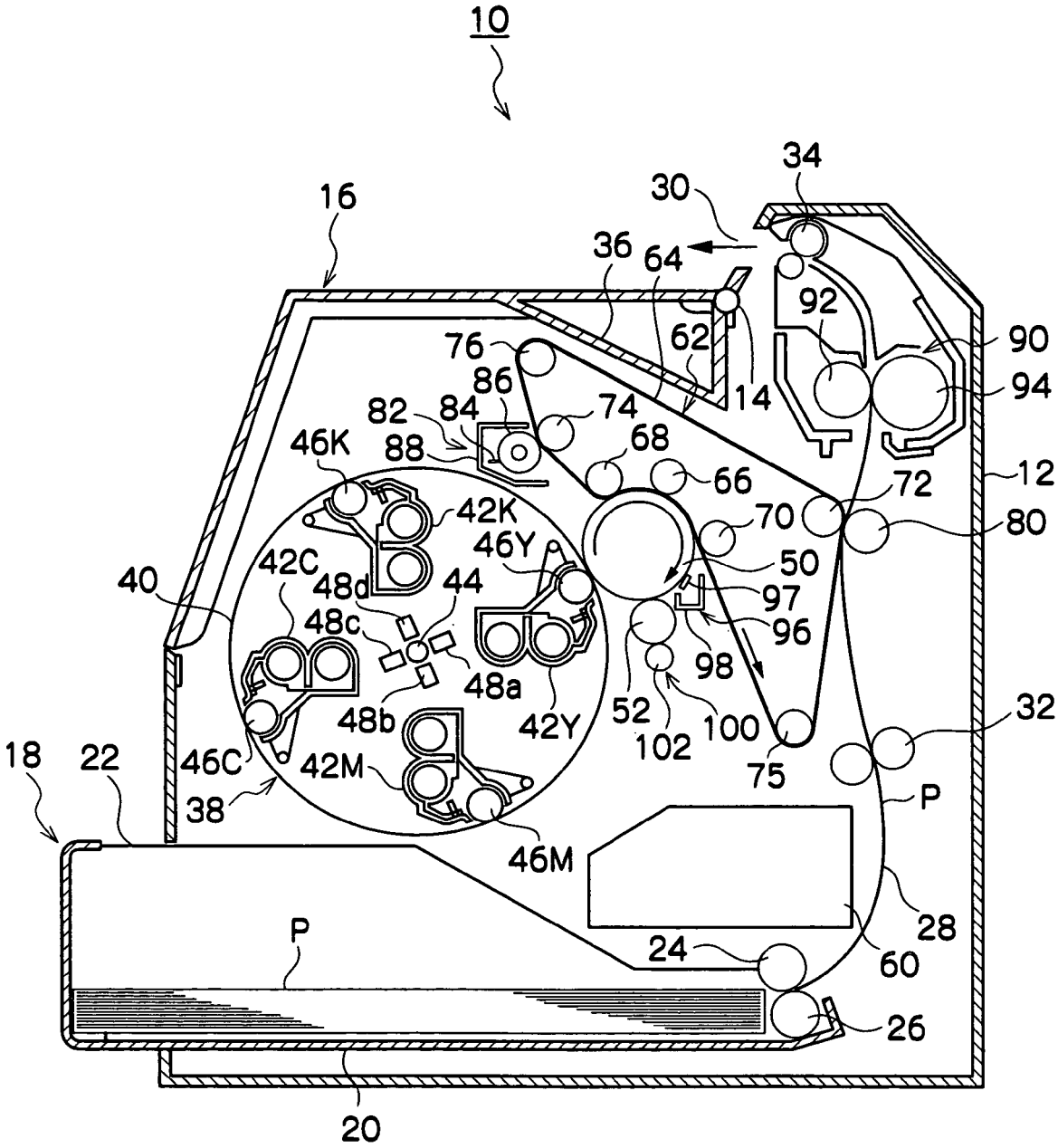
FIG. 1 is a cross-sectional view summarily showing an image forming device of a first exemplary embodiment of the present invention.

An image forming device 10 of the first exemplary embodiment of the present invention is shown summarily in FIG. 1. The image forming device 10 has an image forming device main body 12. An opening/closing cover 16, which rotates freely around a rotation supporting point 14, is provided at the upper portion of the image forming device main body 12. One, for example, sheet feeding unit 18 is disposed at the lower portion of the image forming device main body 12.

The sheet feeding unit 18 has a sheet feeding unit main body 20, and a sheet feeding cassette 22 in which sheets P are accommodated. A feed roller 24, which supplies sheets from the sheet feeding cassette 22, and a retard roller 26, which separates the fed sheets one-by-one, are disposed at the upper portion of the vicinity of the rear end of the sheet feeding cassette 22.

A conveying path 28 is a sheet path from the feed roller 24 to a discharge opening 30. In a vicinity of the rear side (the right side in FIG. 1) of the image forming device main body 12, the conveying path 28 is formed substantially vertical from the sheet feeding unit 18 to a fixing device 90 which will be described later. A second transfer roller 80 and a second transfer back-up roller 72, which will be described later, are disposed on the conveying path 28 at the upstream side of the fixing device 90. Resist rollers 32 are disposed at the upstream side of the second transfer roller 80 and the second transfer back-up roller 72. A discharge roller 34 is disposed on the conveying path 28 in a vicinity of the discharge opening 30.

Namely, the sheets, which are fed-out by the feed roller 24 from the sheet feeding cassette 22 of the sheet feeding unit 18, are separated by the retard roller 26 such that only the uppermost sheet is guided to the conveying path 28. This sheet is temporarily stopped by the resist rollers 32, passes through between the second transfer roller 80 and the second transfer back-up roller 72, which will be described later, at a given timing, and a toner image is transferred thereon. Then, the transferred toner image is fixed by the fixing device 90, and the sheet is discharged-out from the discharge opening 30 by the discharge roller 34 to a discharge portion 36 provided at the top portion of the opening/closing cover 16. The discharge portion 36 is inclined such that the discharge opening portion thereof is low, and the discharge portion 36 becomes gradually higher toward the front (the left in FIG. 1).

A rotary developing device 38 is disposed, for example, at the substantially central portion of the image forming device main body 12. The rotary developing device 38 has, within a developer main body 40, developers 42Y through 42K which respectively form toner images of the four colors of Y, M, C, K. The rotary developing device 38 rotates leftward (counterclockwise in FIG. 1) around a rotary developing device center 44. The developers 42Y through 42K have developing rollers 46Y through 46K respectively, and are pushed in the normal line direction of the developer main body 40 by elastic bodies 48*a* through 48*d* such as, for example, coil springs or the like.

In the rotary developing device 38, the developers 42Y through 42K are disposed such that a photosensitive drum 50 abuts the developing rollers 46Y through 46K. In a state in which the developing rollers 46Y through 46K are not abutting the photosensitive drum 50, portions of the outer peripheries thereof project out, by 2 mm for example, in the radial direction from the outer periphery of the developer main body 40. Further, tracking rollers, whose diameters are slightly larger than the diameters of the developing rollers 46Y through 46K, are provided at the both ends of the respective developing rollers 46Y through 46K, so as to rotate coaxially with the developing rollers 46Y through 46K. Namely, the developing rollers 46Y through 46K of the developers 42Y through 42K are disposed at the outer periphery of the developer main body 40 at 90° intervals around the rotary developing device center 44. Latent images on the photosensitive drum 50 are developed by toners of respective colors, while the tracking rollers of the developing rollers 46Y through 46K abut flanges which are provided at both ends of the photosensitive drum 50 and a predetermined interval is formed between the developing rollers 46Y through 46K and the photosensitive drum 50.

A charging roller 52, which charges the photosensitive drum 50 uniformly, is provided beneath the photosensitive drum 50. The charging roller 52 is made to press-contact the photosensitive drum 50 by an urging mechanism, and is rotated by the rotation of the photosensitive drum 50. Further, an exposure device 60, which writes latent images by rays such as laser light or the like onto the photosensitive drum 50 which is charged by the charging roller 52, is disposed beneath and at the rear surface side of the rotary developing device 38. Moreover, an intermediate transfer device 62 is provided above the rotary developing device 38. The toner images, which have been made visible by the rotary developing device 38, are primarily transferred at a first transfer position onto the intermediate transfer device 62, and conveyed by the intermediate transfer device 62 to a second transfer position which will be described later.

The intermediate transfer device 62 has an intermediate transfer belt 64, a first transfer roller 66, a wrap-in roller 68, a wrap-out roller 70, the second transfer back-up roller 72, a brush back-up roller 74, and tension rollers 75, 76.

The intermediate transfer belt 64, for example, is elastic and is stretched substantially flat above the rotary developing device 38. The top surface side of the intermediate transfer belt 64 is stretched so as to be, for example, substantially parallel to the discharge portion 36 provided at the top portion of the image forming device main body 12. The intermediate transfer belt 64 has a first transfer portion (photosensitive drum 50 wrapping region) which, beneath the intermediate transfer belt 64, contacts the photosensitive drum 50 in a wrapping manner between the wrap-in roller 68 disposed at the upstream side of the first transfer roller 66 and the wrap-out roller 70 disposed at the downstream side of the first transfer roller 66. The intermediate transfer belt 64 is trained around a predetermined range of the photosensitive drum 50, and moves following the rotation of the photosensitive drum 50. Therefore, there is no need for a driving source exclusively used for rotating and driving the intermediate transfer belt 64, and costs can be reduced.

In this way, the toner images on the photosensitive drum 50 are primarily transferred, while being superposed in the order of Y, M, C, K, for example, onto the intermediate transfer belt 64 by the first transfer roller 66, and the intermediate transfer belt 64 conveys the primarily-transferred toner image toward the second transfer roller 80 which will be described later. Note that that wrap-in roller 68 and the wrap-out roller 70 are separated from the photosensitive drum 50.

The intermediate transfer belt 64 is stretched around the six rollers which are the wrap-in roller 68, the wrap-out roller 70, the second transfer back-up roller 72, the brush back-up roller 74, and the tension rollers 75, 76, and the toner images on the photosensitive drum 50 are transferred onto the intermediate transfer belt 64 by the first transfer roller 66.

A planar portion is formed at the rear side (the right side in FIG. 1) of the intermediate transfer belt 64 by the tension roller 75 and the second transfer back-up roller 72. This planar portion is a second transfer portion and faces the conveying path 28.

The brush back-up roller 74 assists a brush roller 86 scraping-off the waste toner which remains on the intermediate transfer belt 64 after the second transfer.

The second transfer roller 80 opposes the second transfer back-up roller 72 of the intermediate transfer device 62, with the conveying path 28 nipped therebetween. Namely, the region between the second transfer roller 80 and the second transfer back-up roller 72 is the second transfer position at the second transfer portion. Due to the assistance of the second transfer back-up roller 72, the second transfer roller 80 secondarily-transfers the toner image, which has been primarily-transferred on the intermediate transfer belt 64, onto a sheet at the second transfer position.

Here, while the intermediate transfer belt 64 rotates three times, i.e., while the intermediate transfer belt 64 conveys the toner image of the three colors of Y, M, C, the second transfer roller 80 is separated from the intermediate transfer belt 64. When the K toner image is transferred, the second transfer roller 80 is made to abut the intermediate transfer belt 64.

Note that a predetermined potential difference is made to arise between the second transfer roller 80 and the second transfer back-up roller 72. For example, in a case in which the second transfer roller 80 is made to be high-voltage, the second transfer back-up roller 72 is connected to the ground (GND) or the like.

A cleaner 82 for the intermediate transfer belt is provided at the intermediate transfer belt 64. The cleaner 82 for the intermediate transfer belt has a scraper 84, a brush roller 86, and a toner recovery bottle 88, and swings around a rotation supporting shaft. The brush roller 86 scrapes-off the waste toner on the intermediate transfer belt 64. The scraper 84 scrapes-off the waste toner adhering to the brush roller 86, so as to clean the brush roller 86. The toner recovery bottle 88 recovers the toner scraped-off by the scraper 84. The scraper 84 is formed from, for example, a stainless thin plate. Further, the brush roller 86 is formed from, for example, a brush which is acrylic or the like and which has been subjected to an electrically-conductive treatment. The brush roller 86 is separated from the intermediate transfer belt 64 while the intermediate transfer belt 64 conveys the toner image, and is made to abut the intermediate transfer belt 64 at a predetermined timing.

A cleaner 96 for the photosensitive drum is provided at the photosensitive drum 50. The cleaner 96 for the photosensitive drum has a blade 97 and a toner recovery bottle 98. The blade 97 scrapes-off the waste toner on the photosensitive drum 50. The toner recovery bottle 98 recovers the toner scraped-off by the blade 97.

A cleaner 100 for the charging roller is provided at the charging roller 52. The cleaner 100 for the charging roller has a cleaning roller 102 and an urging mechanism. The cleaning roller 102 is urged by the urging mechanism toward the peripheral surface of the charging roller 52, is driven by rotation of the charging roller 52, and scrapes-off the foreign matter, such as the toner, external additives of the toner and the like, adhering to the peripheral surface of the charging roller 52 so as to clean the charging roller 52.

The fixing device 90 is disposed above the second transfer position. The fixing device 90 has a heating roller 92 and a pressure-applying roller 94. The fixing devices 90 fixes on the sheet the toner image, which was secondarily-transferred onto the sheet by the second transfer roller 80 and the second transfer back-up roller 72, and conveys the sheet toward the discharge roller 34.

The cleaning of the charging roller 52 will be described here.

Figure 2A:
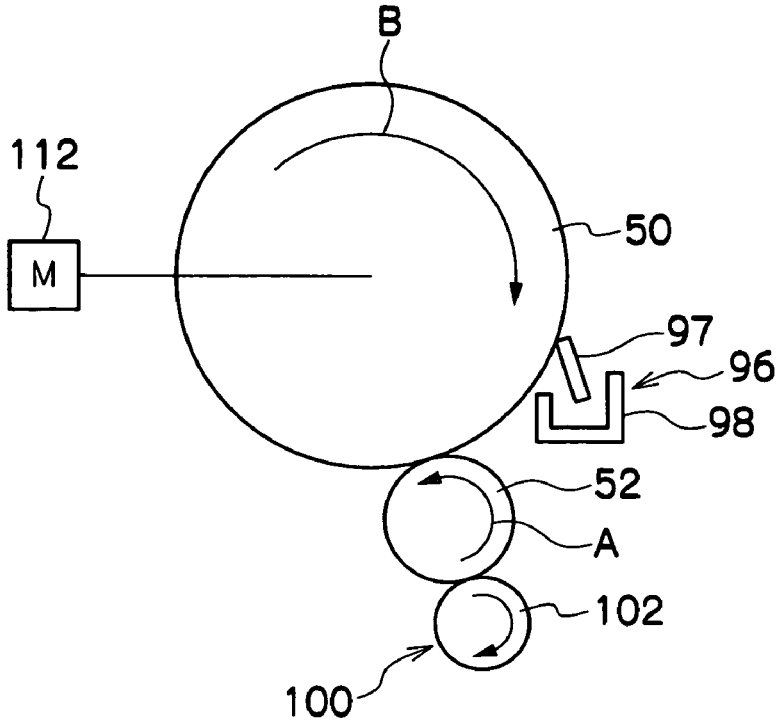
FIGS. 2A and 2B are cross-sectional views showing a photosensitive drum, a charging roller, and a cleaning roller of the image forming device of the first exemplary embodiment of the present invention.
Figure 2B:
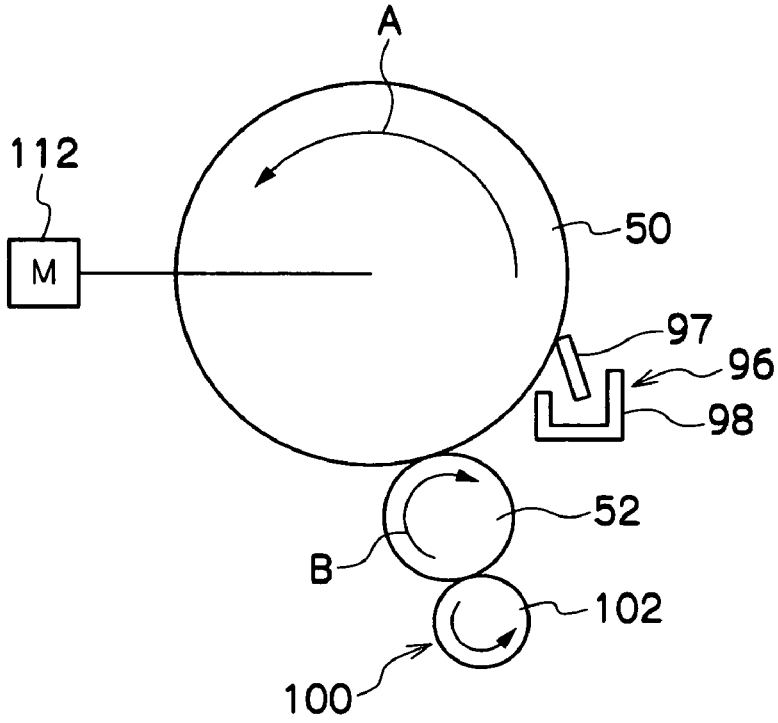

As shown in FIGS. 2A and 2B, the cleaner 96 for the photosensitive drum is provided at the photosensitive drum 50. The toner remaining on the photosensitive drum 50 is recovered by the cleaner 96 for the photosensitive drum. However, there exist substances which cannot be completely recovered by the cleaner 96 for the photosensitive drum, such as external additives of the toner and the like, and these substances adhere to the peripheral surface of the charging roller 52. Therefore, the peripheral surface of the charging roller 52 is cleaned by the cleaner 100 for the charging roller.

The cleaning roller 102 provided at the cleaner 100 for the charging roller is formed from foamed urethane rubber which is a porous elastic body. The cleaning roller 102 is made to press-contact the charging roller 52 such that there is a predetermined amount of biting-in, and the cleaning roller 102 is rotated by the rotation of the charging roller 52.

Figure 3A:
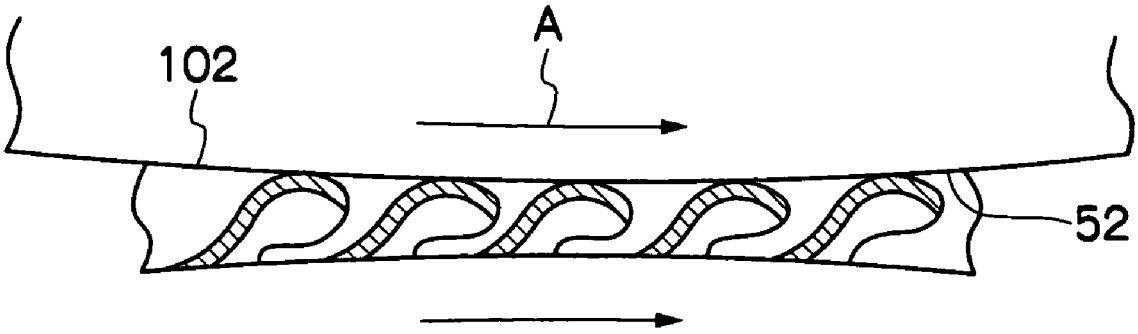
FIGS. 3A and 3B are drawings showing, in an enlarged manner, the state of a nip portion between the charging roller and the cleaning roller of the image forming device of the first exemplary embodiment of the present invention.

Here, as shown in FIG. 3A, the surface of the cleaning roller 102 has convex and concave portions. At the nip portion of the cleaning roller 102 and the charging roller 52, the convex portions of the cleaning roller 102 are tilted toward the downstream side in the direction of rotation of the cleaning roller 102. Therefore, as shown in FIG. 2A, at the time of image formation, when the charging roller 52 is rotating in one direction (the counterclockwise direction shown by arrow A in the drawing), as shown in FIG. 3A, the range over which the cleaning roller 102 can contact the charging roller 42 is always the limited range which is shown by the hatching in the drawing. Only this limited range contributes to cleaning.

Figure 3B:
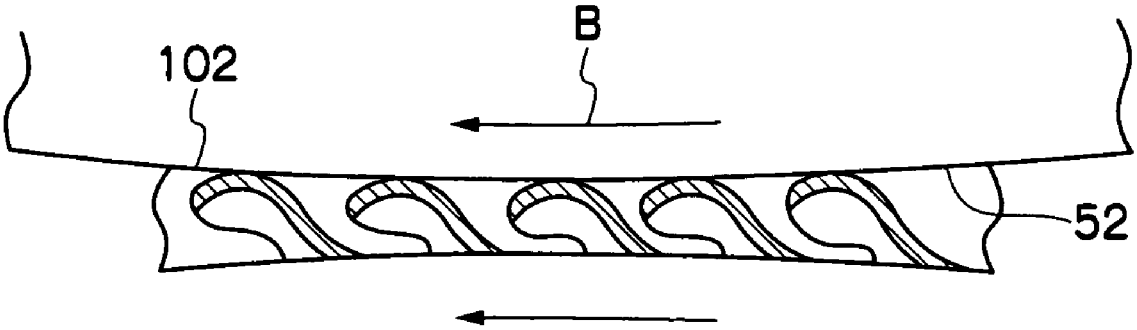

On the other hand, as shown in FIG. 2B, in a case in which the charging roller 52 is rotated in the direction opposite to the direction at the time of image formation (i.e., is rotated in the clockwise direction shown by arrow B in the drawing), as shown in FIG. 3B, the convex portions of the cleaning roller 102 tilt toward the opposite side as at the time of image formation. The range over which the cleaning roller 102 can contact the charging roller 52 thereby becomes a different range than at the time of image formation. Cleaning can be carried out at a range at which there is little accumulation of contamination, and therefore, the ability to maintain the cleaning performance improves.

Thus, in the present exemplary embodiment, as shown in FIG. 2B, a cycle in which the photosensitive drum 50 is rotated in the direction opposite to that at the time of image formation, is implemented at times when images are not being formed. The charging roller 52 which moves following the photosensitive drum 50, and the cleaning roller 102 which moves following the charging roller 52, are rotated in directions opposite to those at the time of image formation.

Figure 4:
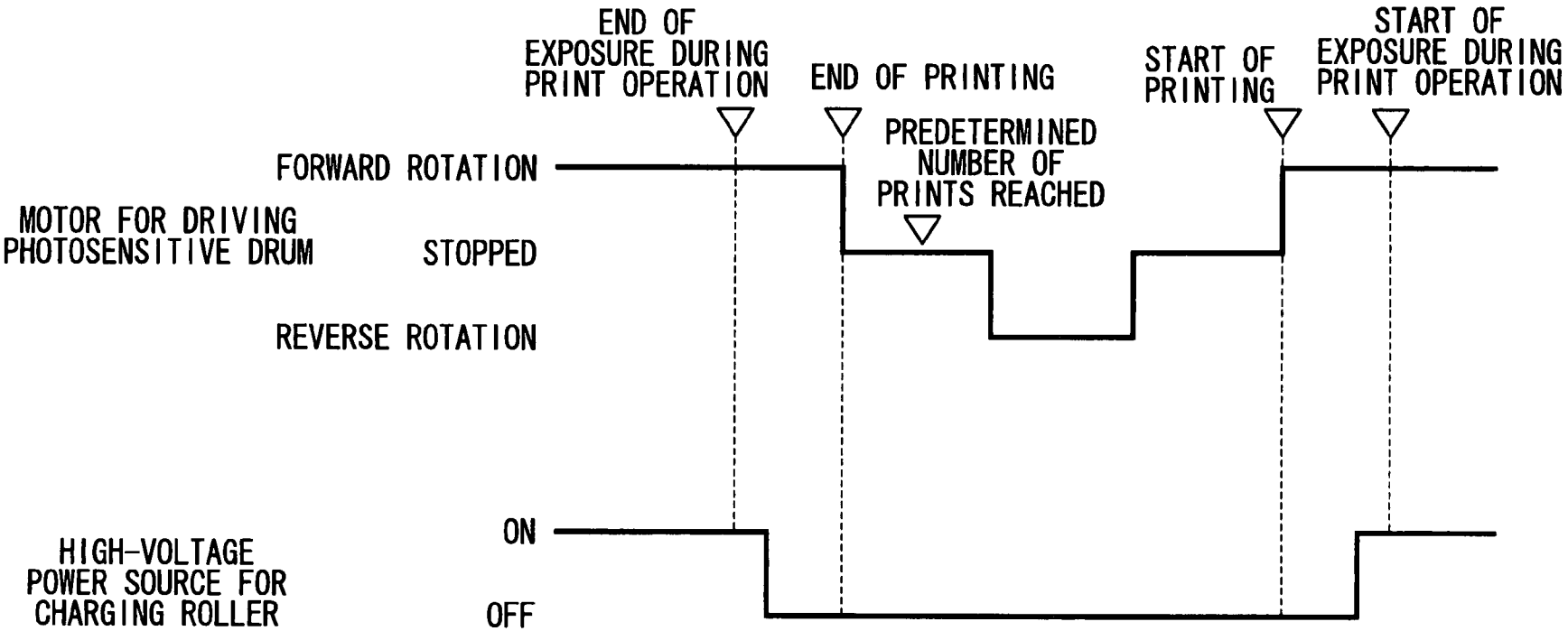
FIG. 4 is a timing chart for explaining a reverse rotation cycle of the cleaning roller in the image forming device of the first exemplary embodiment of the present invention.
Figure 5:
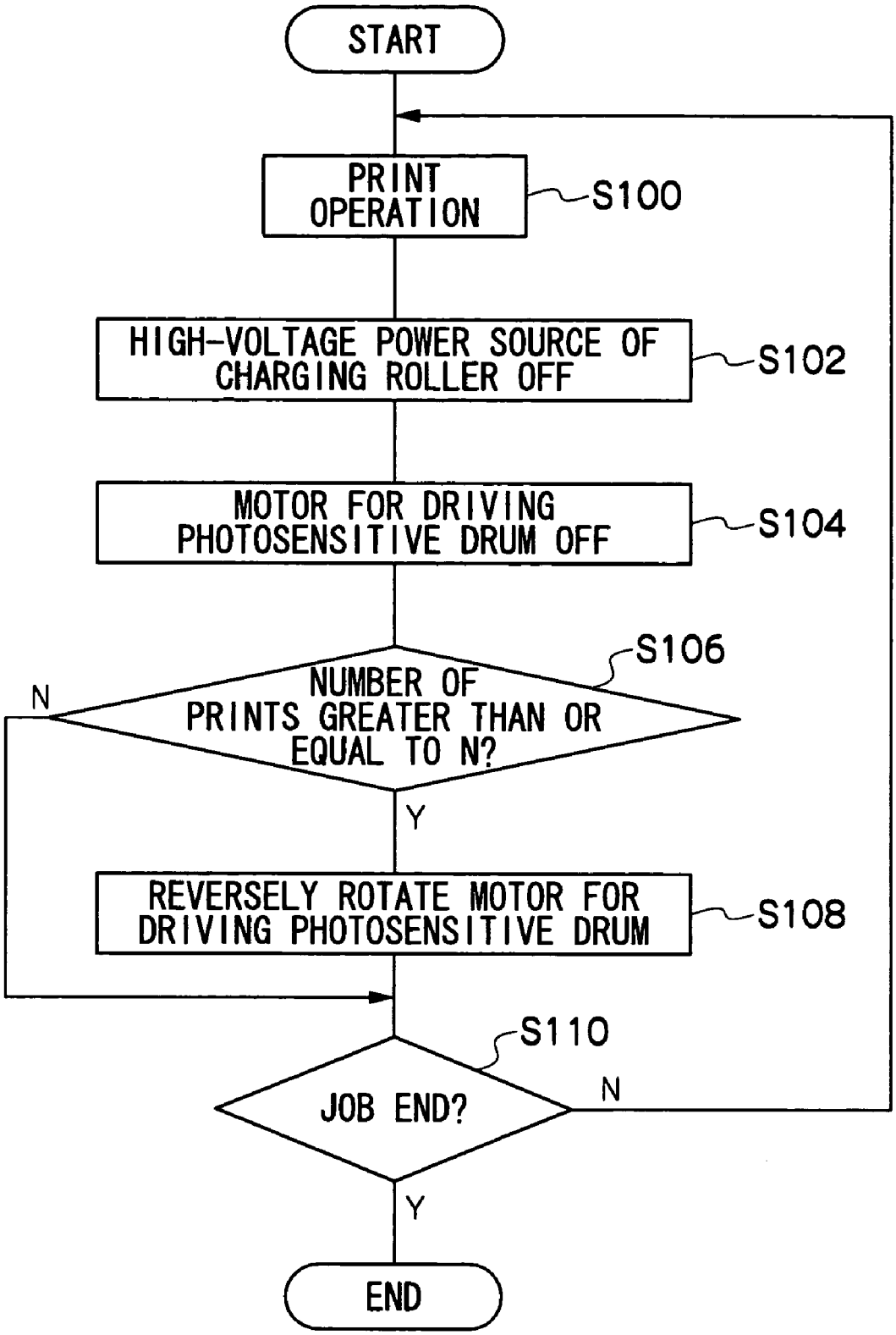
FIG. 5 is a flowchart for explaining the reverse rotation cycle of the cleaning roller in the image forming device of the first exemplary embodiment of the present invention.

Hereinafter, this cycle will be described with reference to the timing chart of FIG. 4 and the flowchart of FIG. 5.

Figure 6:
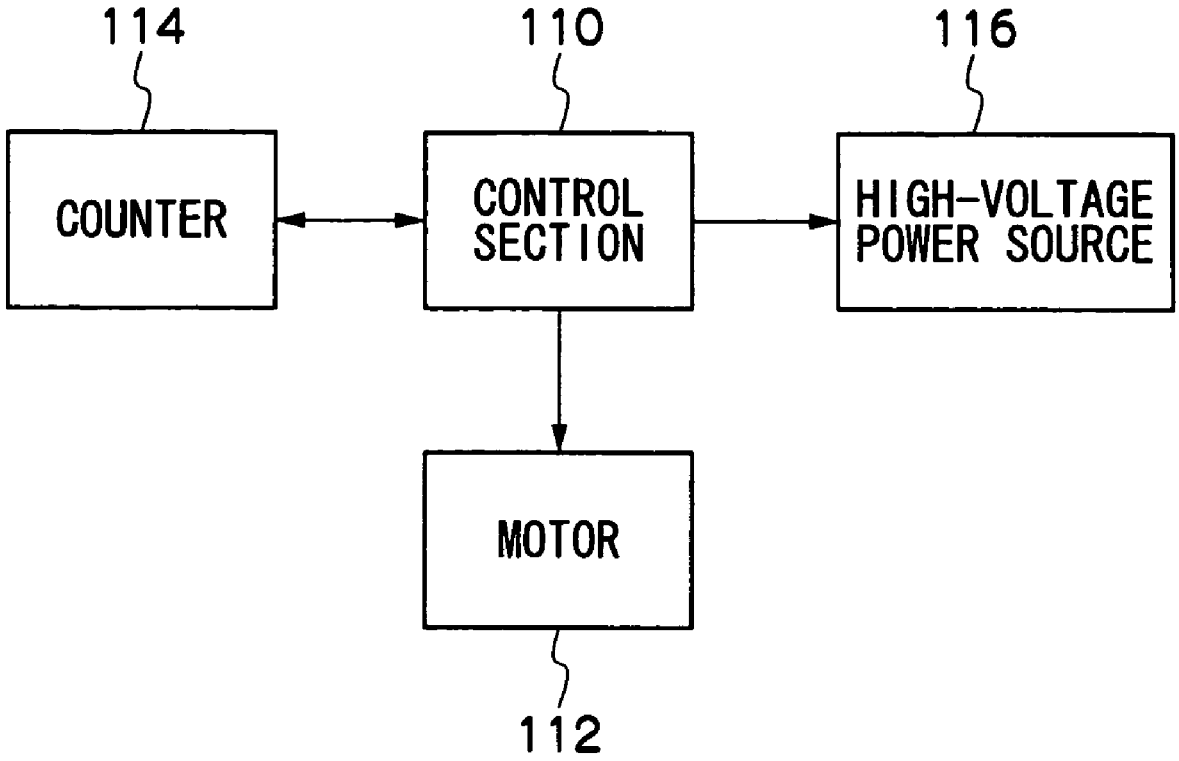
FIG. 6 is a block diagram showing the structure of an electrical system of the image forming device of the first exemplary embodiment of the present invention.

First, when a control section 110 (see FIG. 6), which governs the overall control of the image forming device 10, receives a print job from a host computer or the like, the processing routine starts and control proceeds to step 100. In step 100, a drive signal is outputted from the control section 110 to the respective driving sections, and the print operation is executed. At this time, a motor 112 (see FIG. 6) which drives the photosensitive drum 50 is rotated forward, the photosensitive drum 50 is rotated in the direction of arrow B shown in FIG. 2A, and the charging roller 52 and the cleaning roller 102 are rotated. Further, before the start of exposure by the exposure device 60, a high-voltage power source 116 (see FIG. 6) for the charging roller 52 is turned on, and the photosensitive drum 50 is charged. Moreover, the number of prints is counted by a counter 114 (see FIG. 6).

Next, in step 102, after the exposure by the exposure device 60 has ended, the supply of high-voltage power from the high-voltage power source 116 to the charging roller 52 is turned off, and the control moves on to step 104. In step 104, the driving of the motor 112 is stopped in accordance with the ending of the transfer from the intermediate transfer belt 64 onto the sheet, and the control moves on to step 106.

In step 106, it is judged whether or not the number of prints counted by the counter 114 has exceeded a predetermined number N of prints (e.g., N=1000 prints or N=150 prints). If the judgment is affirmative, the control moves on to step 108, whereas if the judgment is negative, the control moves on to step 110.

In step 108, the motor 112 is rotated in the opposite direction as at the time of image formation, and the photosensitive drum 50 is rotated in the direction of arrow A shown in FIG. 2B, which is the opposite direction as at the time of image formation, and the charging roller 52 and the cleaning roller 102 are rotated in directions opposite to those at the time of image formation. The range over which the cleaning roller 102 contacts the charging roller 52 thereby changes, and cleaning of the charging roller 52 is carried out by a range at which there is little accumulation of contamination. Therefore, the cleaning performance improves.

Here, the amount of rotation of the motor 112 in the opposite direction is an amount which rotates the charging roller 52 one rotation. At the point in time when cleaning of one rotation of the charging roller 52 ends, the rotation of the photosensitive drum 50, the charging roller 52, and the cleaning roller 102 is stopped. Namely, by keeping the amount of reverse rotation of the charging roller 52 to the minimum needed, wear of the cleaning roller 102 is suppressed. Further, wear of the blade 97 which slidingly-rubs the photosensitive drum 50 is promoted due to the reverse rotation operation of the photosensitive drum 50. However, the wear of the blade 97 is suppressed by making the time of the reverse rotation operation of the photosensitive drum 50 short.

Further, when the charging roller 52 is rotated in the opposite direction as at the time of image formation, the charging of the photosensitive drum 50 by the charging roller 52 is turned off, and the electrostatic attractive force between the charging roller 52 and the cleaning roller 102 is turned off. The frictional force of the charging roller 52 and the cleaning roller 102 can thereby be suppressed, and wear deterioration of the cleaning roller 102 can be suppressed.

Next, in step 110, it is judged whether or not the print job has ended. If the judgment is negative, the control returns to step 100, and steps 100 through 110 are repeated. When the judgment is affirmative, the processing routine ends.

As described above, in the present exemplary embodiment, the reverse rotation operation of the photosensitive drum 50, the charging roller 52, and the cleaning roller 102 is carried out only per predetermined number of prints. Therefore, wear of the members which slide and rub against the photosensitive drum 50 and the charging roller 52, such as the cleaning roller 102, the blade 97 of the cleaner 96 for the photosensitive drum, and the like, can be suppressed, and the lifespans of these members can be extended. Further, regardless of which of the A direction and the B direction the charging roller 52 is rotated in, there is no difference in the load applied to the cleaning roller 102. Therefore, as compared with a case in which the cleaning member is a blade, wear of the cleaning member due to the reverse rotation operation of the charging roller 52 can be suppressed.

Next, a second exemplary embodiment of the present invention will be described. Note that structures which are similar to those of the first exemplary embodiment are denoted by the same reference numerals, and description thereof is omitted.

Figure 7A:
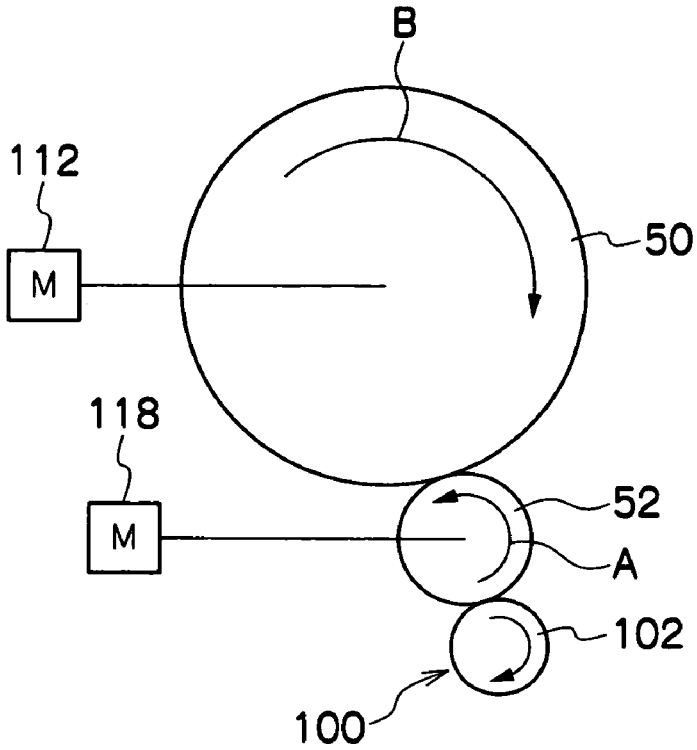
FIGS. 7A and 7B are cross-sectional views showing a photosensitive drum, a charging roller, and a cleaning roller of an image forming device of a second exemplary embodiment of the present invention.
Figure 7B:
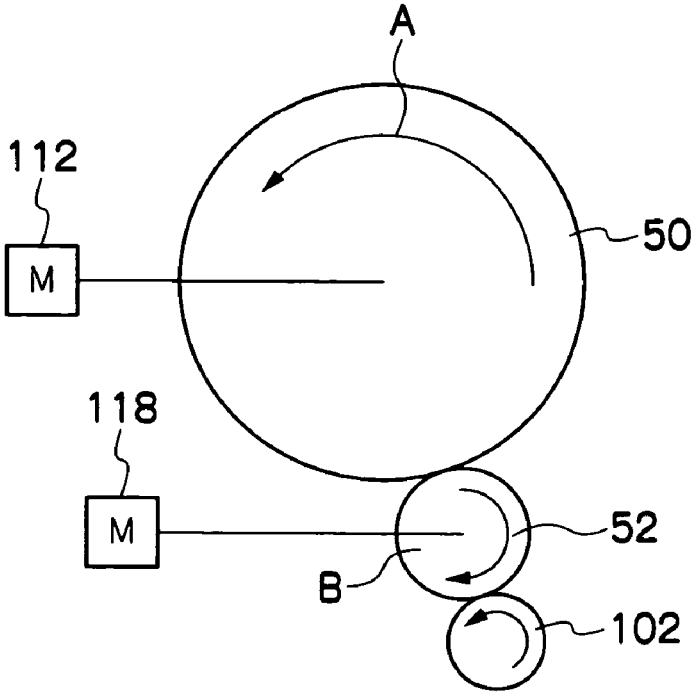
Figure 8:
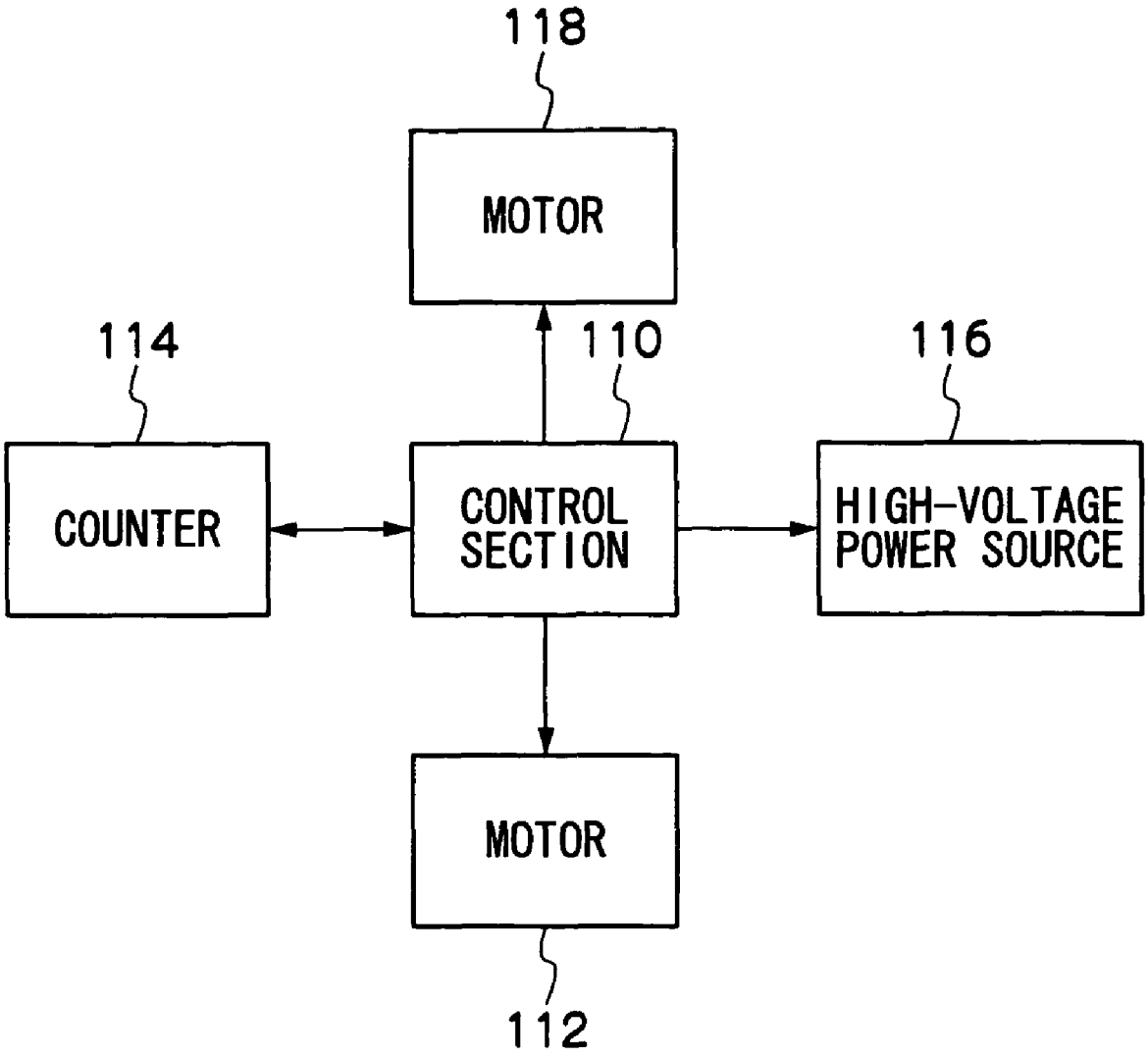
FIG. 8 is a block diagram showing the structure of an electrical system of the image forming device of the second exemplary embodiment of the present invention.
Figure 9:
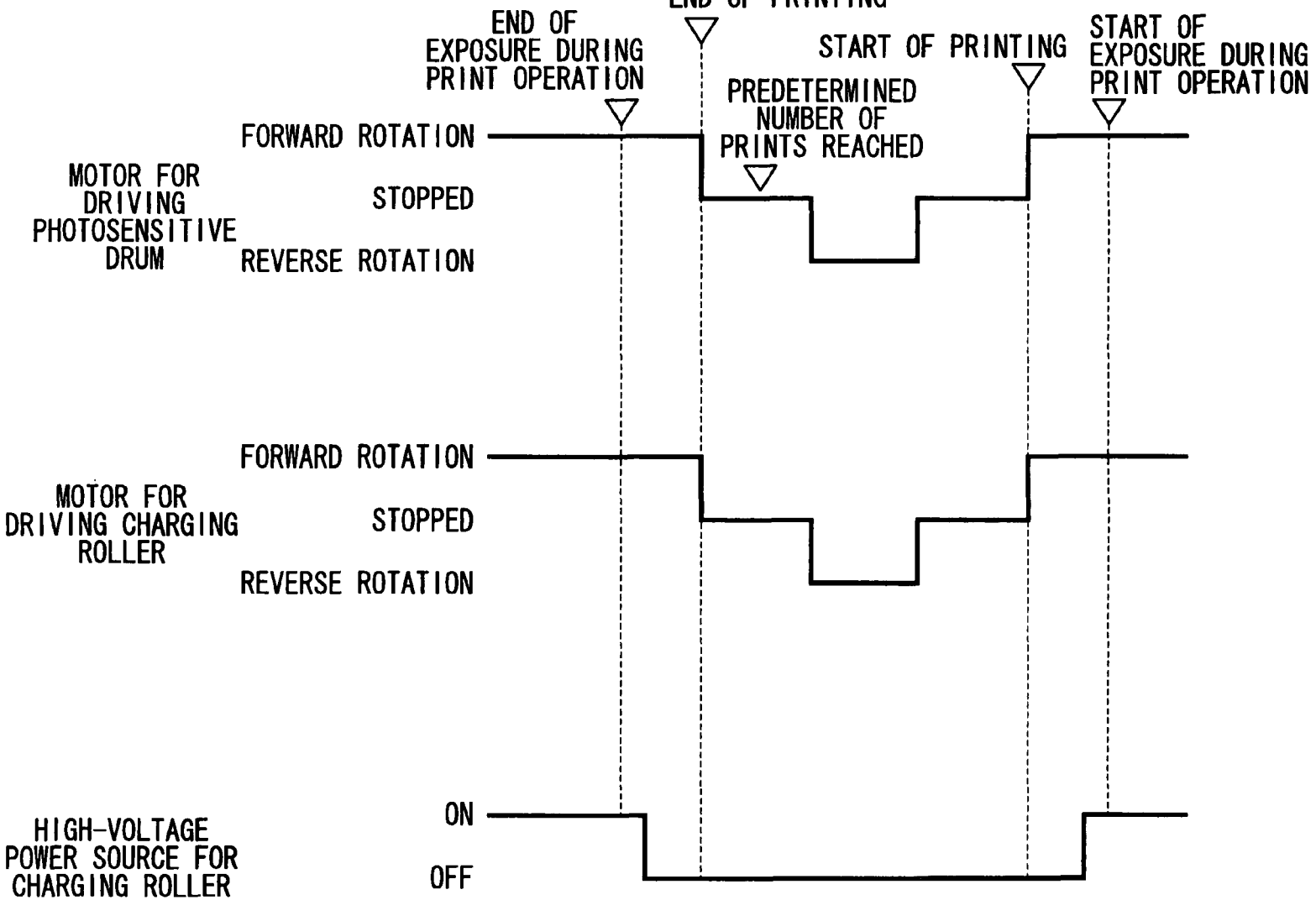
FIG. 9 is a timing chart for explaining a reverse rotation cycle of the cleaning roller in the image forming device of the second exemplary embodiment of the present invention.

In the present exemplary embodiment, as shown in FIGS. 7A and 7B, the charging roller 52 is driven by a motor 118 (see FIG. 8), and the cleaning roller 102 is rotated by the rotation of the charging roller 52. As shown in FIG. 7A and the timing chart of FIG. 9, at the time of the printing operation, the motor 112 is rotated forward, the photosensitive drum 50 is rotated in rotating direction B in the drawing, the motor 118 is rotated forward, and the charging roller 52 is rotated in rotating direction A which is the opposite direction of rotating direction B of the photosensitive drum 50. Further, as shown in FIG. 7B and the timing chart of FIG. 9, after the print operation ends, at the time when the number of prints becomes greater than or equal to the aforementioned predetermined number N, the motor 112 is rotated reversely, the photosensitive drum 50 is rotated in the rotating direction A, the motor 118 is rotated reversely, and the charging roller 52 is rotated in the rotating direction B which is the opposite direction of the rotating direction A of the photosensitive drum 50. Here, the motor 112 for driving the photosensitive drum 50 and the motor 118 for driving the charging roller 52 are controlled synchronously. Further, the rotational speeds thereof are set such that the circumferential speeds of the photosensitive drum 50 and the charging roller 52 are equal. Namely, because the photosensitive drum 50 and the charging roller 52 carry out operations which are similar to those where the charging roller 52 is rotated by the rotation of the photosensitive drum 50, wear at the nip portion between the photosensitive drum 50 and the charging roller 52 can be suppressed, and the lifespans of the photosensitive drum 50 and the charging roller 52 can be extended.

Figure 10:
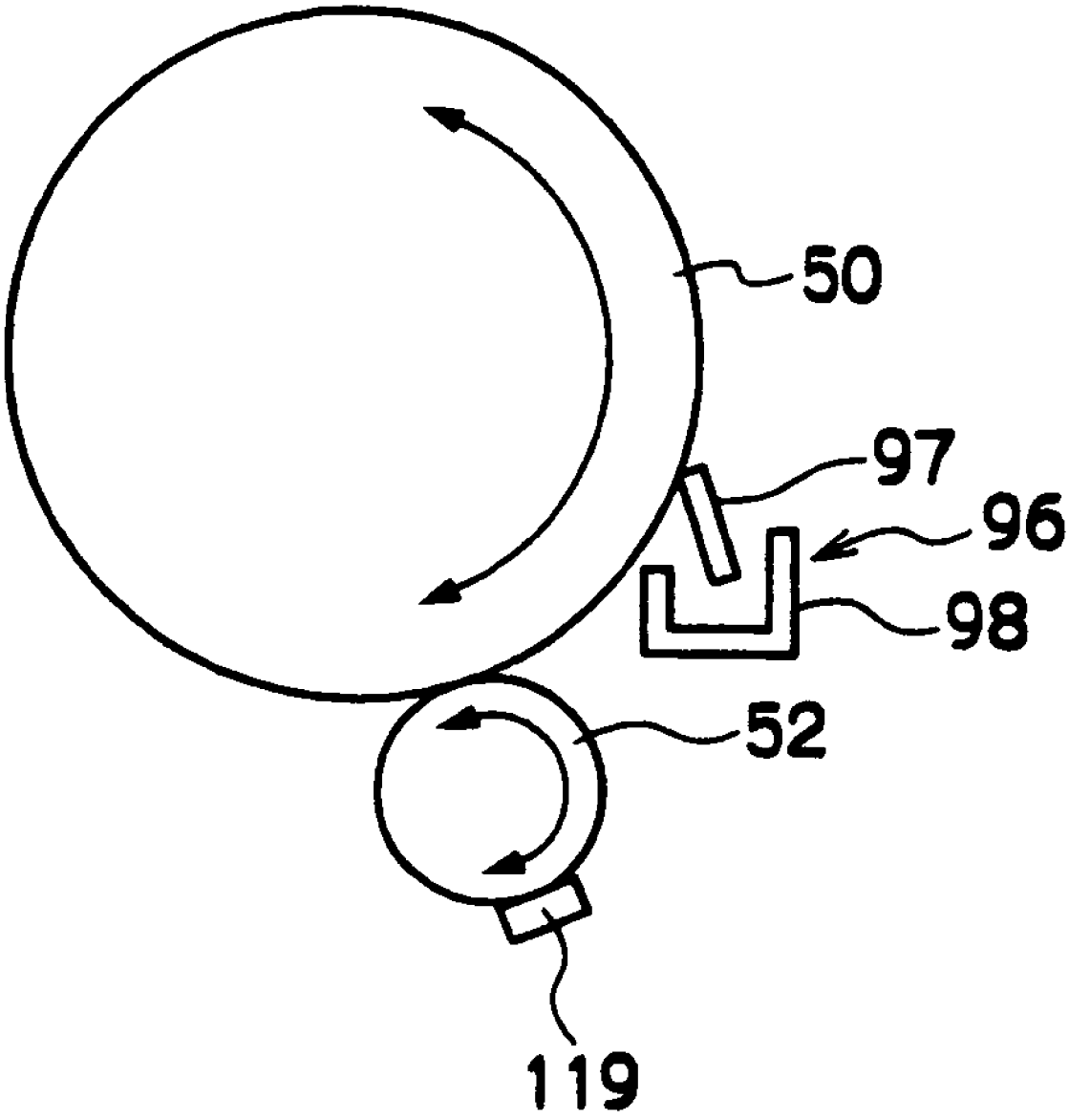
FIG. 10 is a cross-sectional view showing a photosensitive drum, a charging roller, and a cleaning pad of an image forming device of a modified example of the first and second exemplary embodiments of the present invention.

Note that, in the first and second exemplary embodiments, the present invention is described with the cleaning member which is the porous elastic body being the cleaning roller 102. However, as shown in FIG. 10, the porous elastic body may be made to be an immobile cleaning pad 119, and only the charging roller 52 rotated. Here, regardless of which of the A direction and the B direction the charging roller 52 is rotated in, there is no difference in the load applied to the cleaning pad. Therefore, as compared with a case in which the cleaning member is a blade, wear of the cleaning member due to the reverse rotation operation of the charging roller 52 can be suppressed.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The exemplary embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming device comprising:

a photosensitive body;

a charging roller that, while rotating in a first direction, charges the photosensitive body for image formation;

a cleaning roller, formed by an elastic body made of a foamed material, that contacts the charging roller and cleans the charging roller; and a controller that, when the charging roller is not carrying out charging of the photosensitive body for image formation, reverses a direction of movement of the photosensitive body, the photosensitive body, the charging roller and the cleaning roller being in a driving relationship with each other so that a direction of rotation of the charging roller and a direction of rotation of the cleaning roller change in response to a change in the direction of movement of the photosensitive body.

2. The image forming device of claim 1, wherein, when the controller, via driving by the photosensitive body, rotates the charging roller in the direction opposite to the first direction, the controller rotates the charging roller at least one rotation.

3. The image forming device of claim 1, wherein, when the controller, via driving by the photosensitive body, rotates the charging roller in the direction opposite to the first direction, the controller turns the charging of the photosensitive body by the charging roller off.

4. The image forming device of claim 1 further comprising a photosensitive body driving component that drives the photosensitive body, wherein the charging roller can be rotated by rotation of the photosensitive body, and the controller controls the photosensitive body driving component such that the photosensitive body rotates in two directions.

5. The image forming device of claim 1 further comprising a charging roller driving component that drives the charging roller, wherein the controller controls, via driving by the photosensitive body, the charging roller driving component.

6. The image forming device of claim 1, wherein the cleaning roller can be rotated by rotation of the charging roller.

7. The image forming device of claim 1, wherein the elastic body forming the cleaning roller is a porous elastic body.

8. The image forming device of claim 7, wherein the cleaning roller is pressed against the charging roller.

9. The image forming device of claim 1, wherein the controller, via driving by the photosensitive body, rotates the charging roller in the direction opposite to the first direction, only in cases in which a number of images formed by the image forming device exceeds a predetermined number.

10. The image forming device of claim 1, wherein a first surface of the cleaning roller contacts the charging roller as the charging roller rotates in the first direction, and a second surface of the cleaning roller, which is different from the first surface, contacts the charging roller as the charging roller rotates in the direction opposite to the first direction.

* * * * *